United States Patent [19]

Ralston

[11] Patent Number: 4,519,477

[45] Date of Patent: May 28, 1985

[54] LADDER STABILIZING APPARATUS

[76] Inventor: Robert Ralston, 294 Silverstone Dr., Townhouse 71, Rexdale, Ontario, Canada, M9V 3J4

[21] Appl. No.: 551,802

[22] Filed: Nov. 15, 1983

[30] Foreign Application Priority Data

Nov. 15, 1982 [CA] Canada ..... 415580

[51] Int. Cl.[3] ..... E06C 5/36; E06C 7/44; E06C 1/08

[52] U.S. Cl. ..... 182/107; 182/172; 182/200

[58] Field of Search ..... 182/107, 108, 172, 214, 182/200

[56] References Cited

U.S. PATENT DOCUMENTS

| | | | |
|---|---|---|---|
| 1,385,319 | 7/1921 | Enke | 182/172 |
| 2,423,477 | 7/1947 | Brimboeuf | 182/172 |
| 3,012,628 | 12/1961 | Zumbaum | 182/172 |
| 3,025,926 | 3/1962 | Vives | 182/201 |
| 3,618,703 | 11/1971 | Wilke | 182/107 |
| 3,856,112 | 12/1974 | Stewart | 182/172 |
| 4,147,231 | 4/1979 | Chantler | 182/172 |
| 4,175,641 | 11/1979 | Reyes | 182/172 |
| 4,244,446 | 1/1981 | Mair | 182/172 |
| 4,311,207 | 1/1982 | Lurry | 182/214 |

FOREIGN PATENT DOCUMENTS

| | | | |
|---|---|---|---|
| 29094 | 3/1907 | Austria | 182/107 |
| 2444786 | 8/1980 | France | 182/172 |
| 2053334 | 2/1981 | United Kingdom | 182/172 |

*Primary Examiner*—Reinaldo P. Machado
*Attorney, Agent, or Firm*—Hirons, Rogers & Scott

[57] ABSTRACT

An adjustable stablizing device which is attached to an extension ladder having hollow rungs without requiring modification of the ladder structure or affecting normal operation of the ladder is described. The device has two stabilizing elements made of aluminum which are located at different side of the ladder. Each stabilizing element has an upper and a lower bracket which are connected together by two rigid pivotably-linked longitudinal members. The stabilizing elements are connected to each other by rods which extend through the hollow rungs of the ladder and which connect the upper and the lower brackets. The lower bracket and the lower longitudinal member are pivotably connected, and the upper bracket has a number of apertures spaced lengthwise of the ladder. By choosing the aperture to which the upper longitudinal member is connected, the attitude of each of the lower members is varied via the pivotable connection so as to lie on the surface adjacent the ladder side. When not in use, the stabilizing elements are retained flush against the sides of the ladder for storage.

15 Claims, 14 Drawing Figures

LADDER STABILIZING APPARATUS

The present invention relates to stabilising apparatus for extension ladders having hollow rungs. More particularly, the invention relates to an adjustable stabilising device which can be secured to one or to both sides of the ladder without interrupting the structural integrity of the ladder.

It has been proposed to provide the lower end of an extension ladder, or a step ladder, with stabilizing members which effectively decrease the tendency for the ladder to tilt laterally. In some of these proposals the stabilising devices can be adjusted such that the ladder can be located on uneven ground without having an increase in tendency to tilt. However, with most of the proposed devices, the connection between the stabilising device and the frame of the ladder involves drilling holes in the frame or inserting screws or the like which destroy the original structural integrity of the ladder. If the structure of the ladder is modified in any way to accept such stabilising devices, then the warranty on a ladder is invalidated. Consequently in industry, where the need for increased ladder stability is most needed, use of stabilising devices which require structural modification of the ladder structure results in invalidation of manufacturers warranty. This can cause liability and compensation problems if an accident occurs using a ladder which has had its structure modified.

An object of the present invention is to obviate or to mitigate the above said disadvantages.

Broadly, the invention comprises using hollow rungs of a ladder to provide a support structure for stabilising apparatus by connecting a stabilising device to the ladder using the hollow rung.

In, one aspect of the invention there is provided stabilising apparatus for use with a ladder having hollow rungs, the apparatus having at least one stabilising device locatable at one side of the ladder, the stabilising device having at least one first connecting means for extending through a rung of the ladder and being securable at the other side of the ladder, the stabilising device having base means for supporting the stabilising device on a surface, whereby in use, the stabilising device has on a surface adjacent the ladder and effectively increases the base width of the ladder.

In a preferred embodiment of the invention there is provided stabilising apparatus for use with a ladder having hollow rungs, the stabilising apparatus having at least two stabilising devices, at least one stabilising device being located on each side of the ladder, each stabilising device having upper and lower bracket means connected together by linked upper and lower longitudinal members, the respective upper and lower members of the stabilising devices being connected together by respective rods which extend through the rungs of the ladder, whereby, in use, the lower longitudinal members lie adjacent a surface and increase the effective base width of the ladder.

Preferably each stabilising device is adjustable by varying the point of securement between the upper bracket means and the upper longitudinal members to alter the attitude of lower longitudinal member for support on the surface adjacent its side of the ladder.

Embodiments of the present invention will now be described by way of example with reference to the accompanying drawings in which:

FIG. 1 is a cross-sectional view taken along D—D upper member of FIG. 1;

Figure 1:
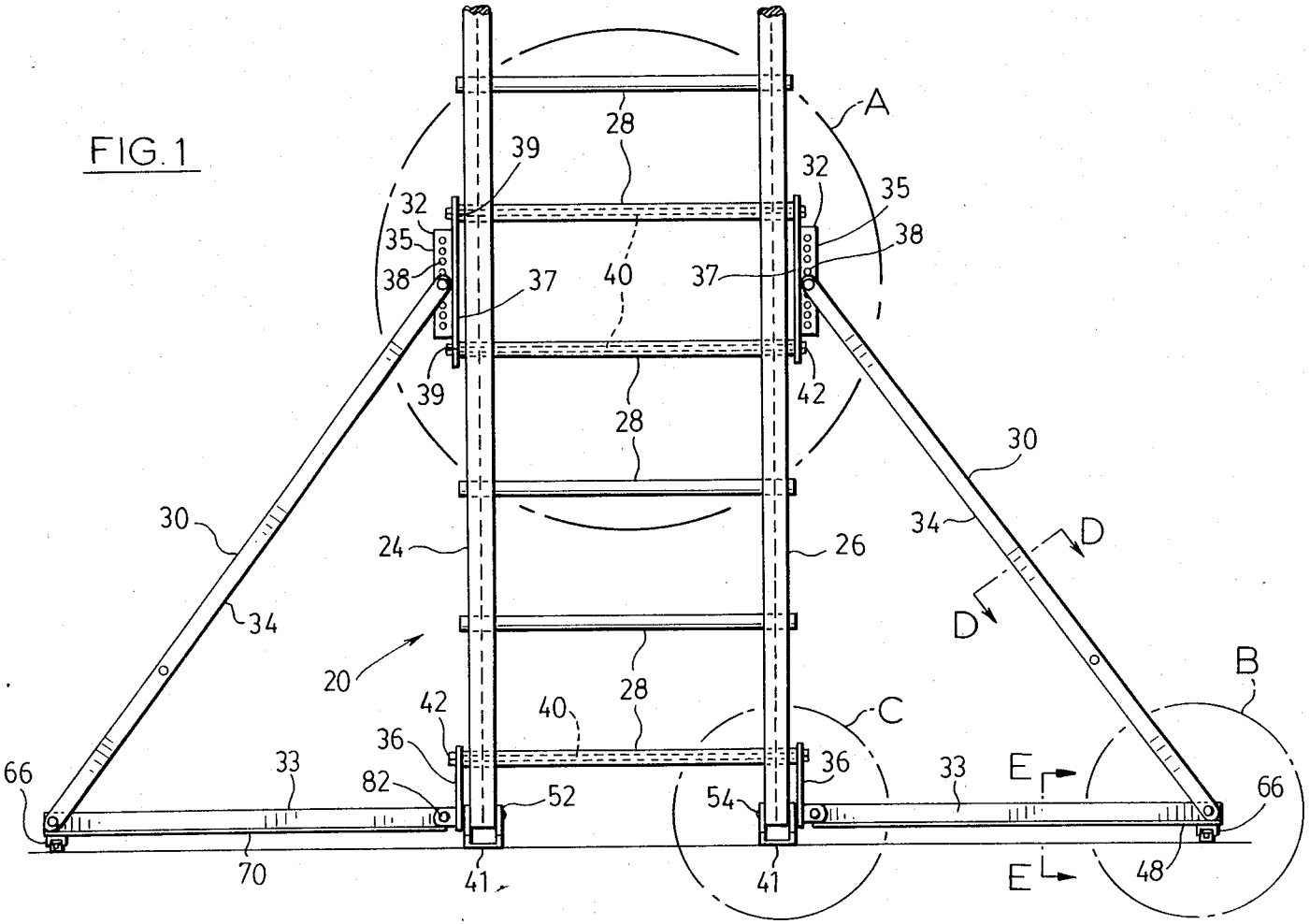
FIG. 1 is a front view of the lower end of an extension ladder with two stabilisers in place according to a preferred embodiment of the invention.
Figure 5:
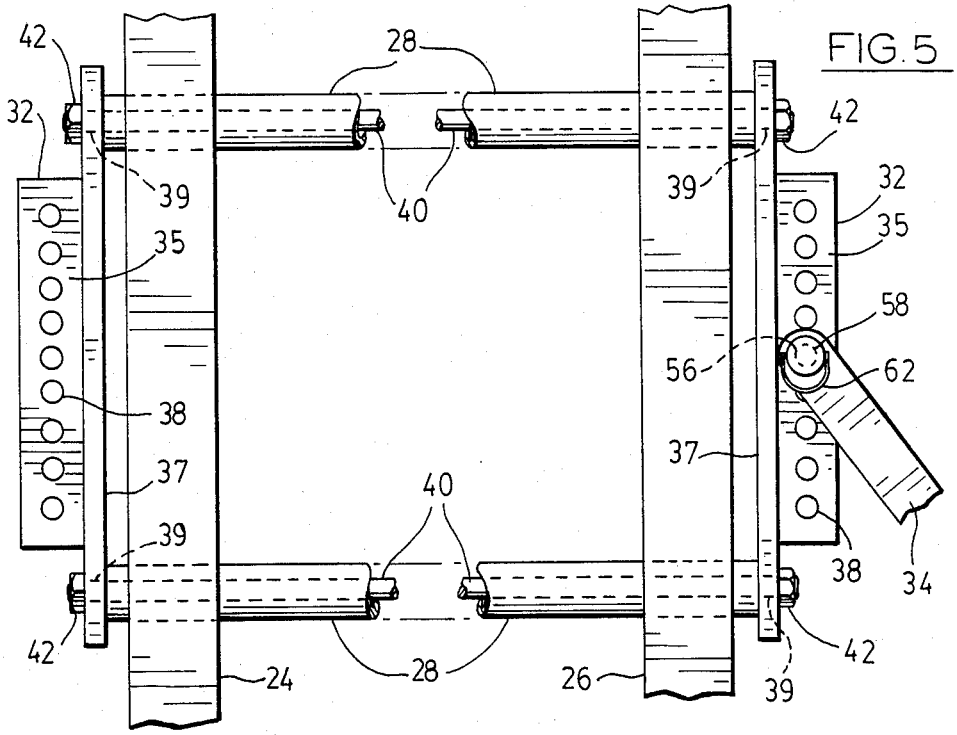
FIG. 5 is an enlarged view of area A of FIG. 1 and shows connection of one upper member at the bracket and the connecting rods extending through the ladder rungs and holding the brackets in place.
Figure 6:
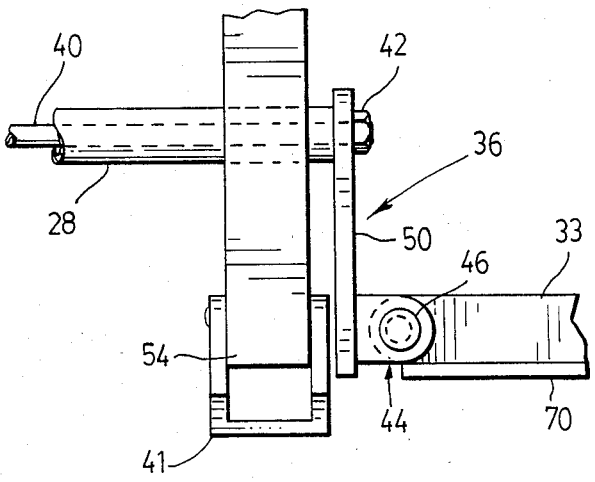
FIG. 6 is an enlarged view of area C of FIG. 1 and shows a lower bracket attached to one foot of the ladder.
Figure 7:
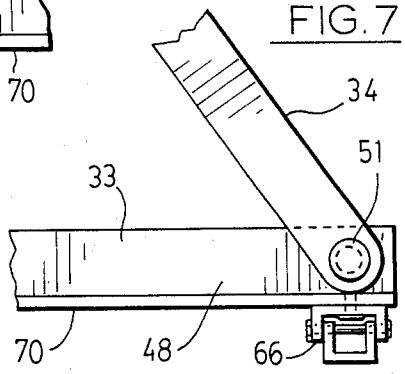
FIG. 7 is an enlarged view of area B of FIG. 1 and shows the pivotal connection between the lower member and the upper member, and also the swivel foot.
Figure 8:
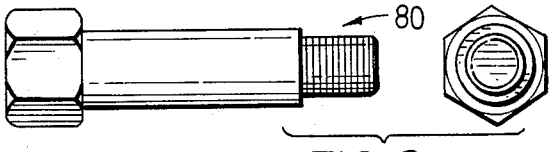
FIGS. 8 and 9 are detailed views of a pin used to fasten pieces of the stabiliser and to permit pivotal movement.
Figure 9:
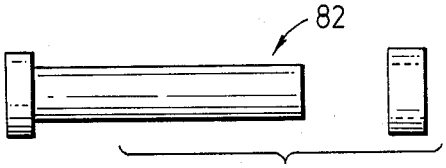
Figure 10:
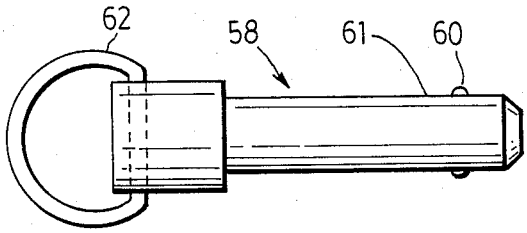
FIG. 10 is a detailed view of the adjustment pin.
Figure 12:
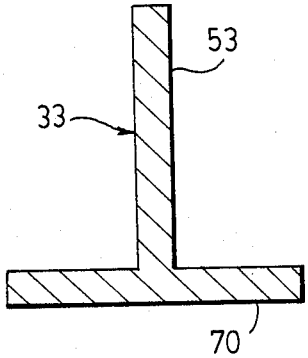
FIG. 12 is a cross-sectional view taken along E—E of the lower member in FIG. 1.
Figure 11:
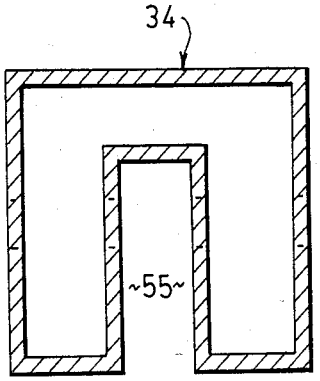

Referring now to FIG. 1 of the drawings, in a preferred embodiment an aluminum extension ladder 20 has a lower section formed of sides 24, 26 which are interconnected by hollow rungs 28. There are two stabilisers 30, shown attached to ladder sides 24, 26 respectively. As best shown in FIG. 9, each stabiliser has an upper right-angle bracket 32, connected by an upper rigid member 34 and a lower rigid member 33, which are pivotably connected via pin 82 (FIG. 9), to a lower bracket 36. The stabilisers 30 are identical. One stabiliser will be described in detail in the interest of clarity, it being appreciated that the description applies to the other stabiliser. An upper right-angle bracket 32 has a side wall 35 with a plurality of apertures 38 therein. The brackets 32 also have side walls 37 and are integrally and perpendicularly connected to side walls 35 and which extend beyond the distance between two adjacent rungs 28. Each side wall 37 has two apertures 39 which coincide with respective rungs 28. As shown most clearly in FIG. 5 the brackets 32 are connected to each other by rods 40 (shown by dashed lines), each of which pass through the rungs 28 of the ladder and through apertures 39 of the side walls 37. The rods 40 have threaded ends (not shown) which are secured to the side walls 37 by nuts 42. Similarly, as shown best in FIG. 6 the lower bracket 36 is located at respective feet 52, 54 of each ladder wall. The lower brackets 36 have upper portions 50 secured to each other in the same manner as brackets 32. FIG. 8 shows that at an end 44 of each bracket 36, there is a pivotal connection in the form of a bolt 80 which secures the bracket 36 to the lower member 33. This pivotal connection permits, during adjustment of the stabilising portion, relative movement between the ladder sides 24, 26 and the lower members 33 in the plane of the ladder. Each bracket 36 also has a container 41 connected thereto in which the feet and the ladder are retained. FIG. 12 shows that the lower member 33 is generally T-shaped in cross-section and has an end 48, best shown in FIG. 7, which is pivotably connected to the upper member 34 via a pin 50. The upper member 34 shown in FIG. 11 has a U-shaped cross-section with the recess 52 adapted to receive the upstanding portion 53 of the 'T'-shaped lower member 33 during relative pivotal movement between the members 33 and 34. The upper members 34 are connected at their upper end 54 via apertures 56 to one of the apertures 38 in side walls 35 of brackets 32 by an adjustment pin 58 (shown best in FIG. 5). The adjustment pin 58 has spring loaded ball-bearings 60 at an end 61 (FIG. 10) which serve to secure the upper member 34 and the bracket 32 via apertures 38 and 56. The adjustment pin 58 includes a handle 62 which facilitates removal or insertion of the pin.

Figure 4:
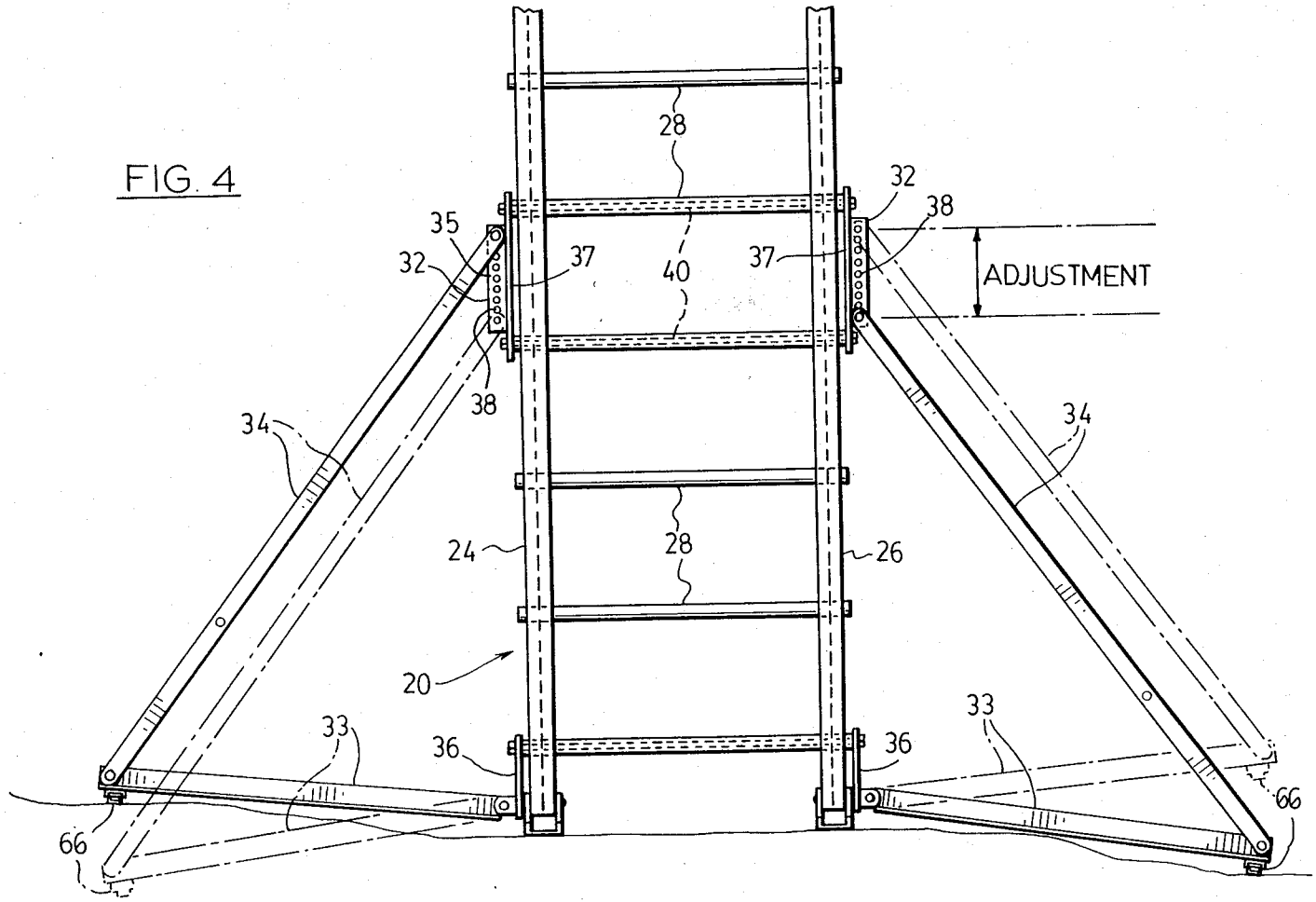
FIG. 4 is a view similiar to FIG. 1 and shows various stabiliser positions by adjustment between the ladder and the upper element.

FIG. 1 shows the ladder 20 located on a level surface whereby the lower members 33 are substantially horizontal. These members 32 effectively increase the base width of the ladder and counteract any movement which tends to tilt the ladder laterally. FIG. 4 shows that the ladder can easily be adjusted to conform to uneven surfaces and this is achieved by removing the adjustment pins 58 and relocating the upper members 34 at appropriate points on the side walls 35 of the brackets 32 such that the attitude of the lower members with respect to the surface are altered accordingly (FIG. 4). As each stabiliser is independently adjustable this means that a wide range of varying ladder support surfaces can be accommodated.

Figure 2:
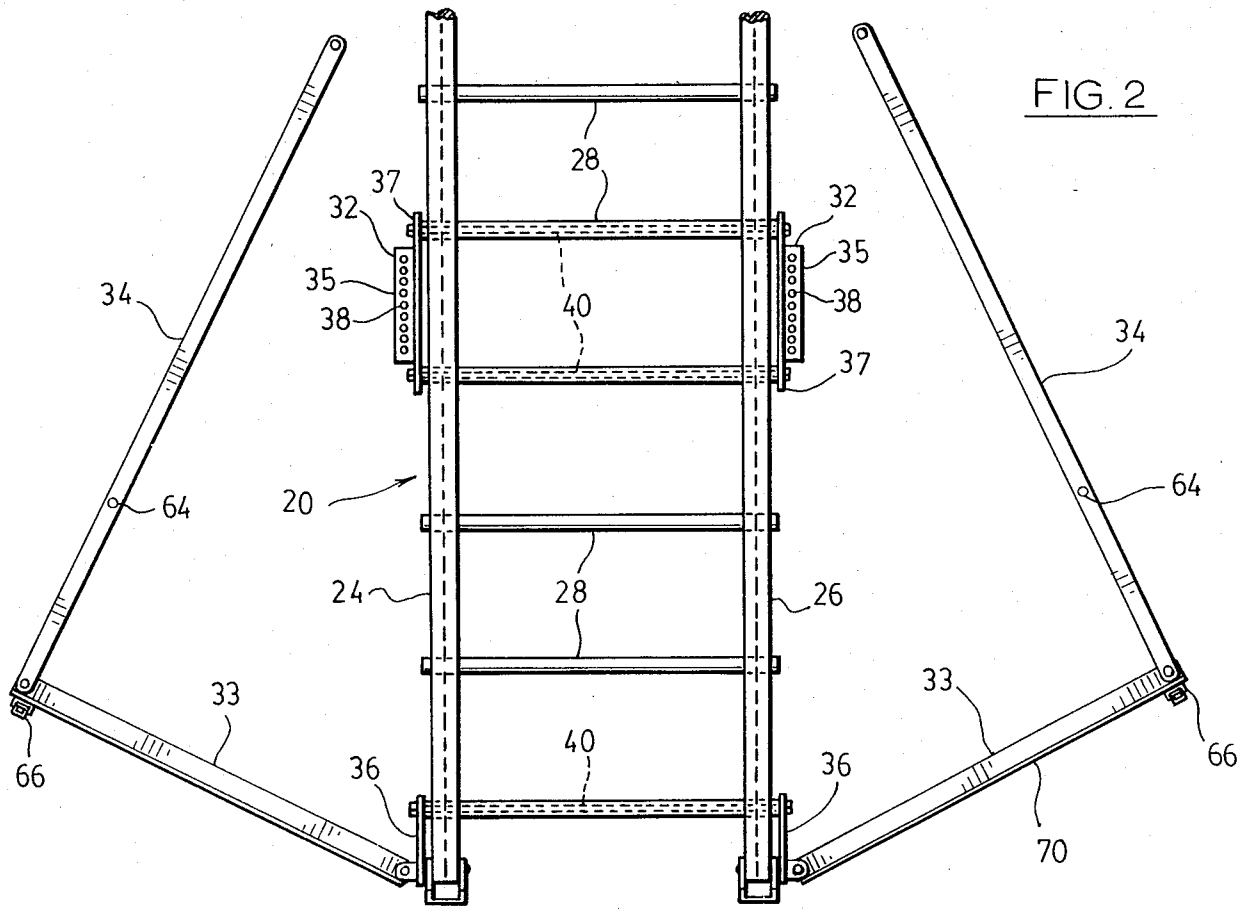
FIG. 2 is a view similiar to that of FIG. 1 in which the stabilisers are disconnected from the ladder at their upper ends.
Figure 3:
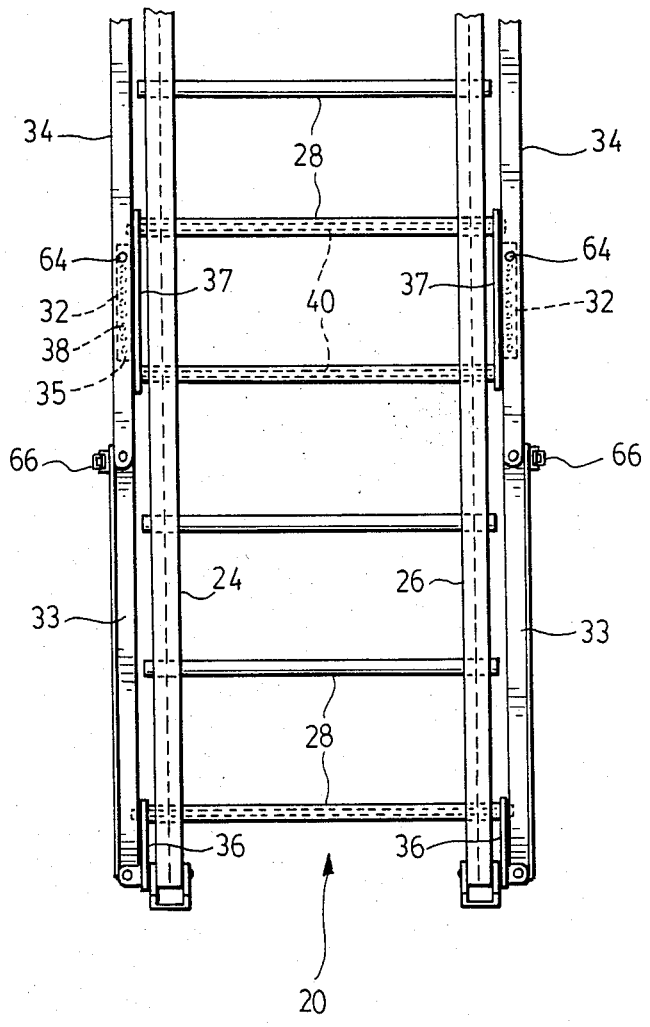
FIG. 3 shows the view of FIGS. 1 and 2 when the stabilisers are in their stored condition.

Referring to FIGS. 2 and 3, when the ladder is not in use, the adjustment pins 58 are removed and the elements 33, 34 unfolded (FIG. 2) such that they lie substantially flush against the ladder sides 24, 26 (FIG. 3). Apertures 64 in members 33 are positioned such that, when the stabilisers are flush against the ladder walls, they coincide with one of the apertures 38 in side walls 35. The adjustment pins 58 are then inserted through both apertures 38 and 62 and the stabilisers are secured in this position for storage (FIG. 3).

Figure 13:
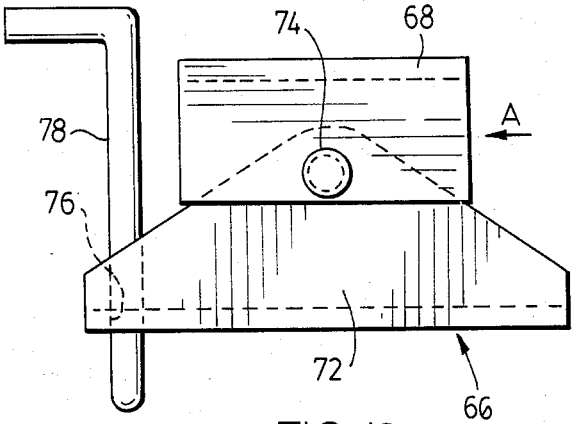
FIG. 13 is a more detailed view of the swivel foot shown in FIG. 1 and in FIG. 7.
Figure 14:
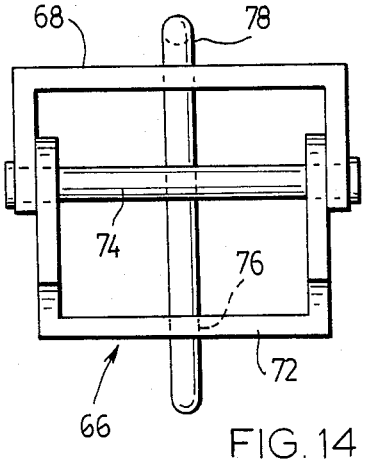
FIG. 14 is a view of FIG. 13 taken in the direction A.

As FIGS. 12 and 13 illustrate, a swivel foot 66 is provided on the lower member 33. The swivel foot 66 has a U-shaped member 68 secured to the underside 70 of the lower member 33. A swivel portion 72 is connected to the U-shaped member 68 by a pin 74. The pin 74 permits the swivel portion 72 to pivot relative to the U-shaped member 68 and to the member 33. This enables the lower member 33 and thus the ladder 20 to be positioned on the ground for best support. To further reduce the risk of movement of the stabilisers, each swivel foot has an aperture 76 therein to receive an anchor pin 78, which is manually inserted after the ladder and the stabilising devices have been positioned as desired. This anchor pin can then be hammered into the ground.

It should be noted that the inclusion of the stabilising devices on the ladder do not affect the extension or retraction movements of moveable ladder section since the wall 37 of bracket 32 is wider than the wall of the extension portion of the ladder.

It should be understood that various modifications may be made to the stabilisers hereinbefore described without departing from the scope of the invention. For example, although two stabilising devices are preferred, one stabiliser could be used to provide an effective increase in ladder base width. The externally threaded rods 40 may be replaced by rods which have ends which are drilled and tapped to give internal threads. In this case, the rods receive countersunk screws which lie flush with the walls 37 bracket members 34. In addition, although the stabilisers described are preferably used with an aluminum extension ladder, a non-extensible ladder made of any other material could be used provided it had the hollow rungs.

Although stabilising device components are made of aluminum any other suitable material could be used.

The stabilising device has distinct advantages over prior art devices; there is no structural modification required to the ladder itself thus the ladder warranty given by a manufacturer will not be invalidated; the stabilisers are independently adjustable to conform to uneven ground; they can be fitted to existing extension ladders with hollow rungs without affecting the relative movement between ladder sections, and they can be folded flat against the ladder sides and retained thereat when not in use to facilitate storage, thereby minimising the amount of assembly and dismantling time required.

Thus, an improved stabilising device for extension ladders is presented which overcomes problems and limitations associated with prior art devices.

I claim:

1. Stabilising apparatus for use with a ladder having hollow rungs and comprising:

at least one stabilising device having first and second bracket means for securing the stabilising device at respective upper and lower positions along a side of the ladder;

each bracket means coupled to one end of at least one elongate rod which can be passed through a hollow rung and its other end secured to the other side of the ladder;

a first elongate member having one end adapted to be removably coupled to the upper bracket means, and its other end for acting as a foot of the stabilising device for effectively increasing the base width of the ladder;

a second elongate member shorter than the first elongate member having one end pivotably connected to the lower bracket means, and its other end pivotably connected to the first elongate member; the pivotal connections permitting pivotal movement in the plane of the ladder;

the stabiliser being movable between an in-use position and a stored position; whereby in the in-use position the first elongate member is displaced at an angle from the side of the ladder by said second elongate member which acts as a supporting strut, to locate the other end of the first elongate member at a distance from the foot of the ladder and effectively increase the base width of the ladder, and in the stored position said first and second elongate members can be folded along the side of the ladder and retained therein by retaining means.

2. Apparatus as claimed in claim 1 including means for adjusting the height of the foot of the first longitudinal member relative to the foot of the ladder, said height adjusting means being provided by said upper bracket means having a plurality of locations spaced in the direction of the ladder, and to any one of which said one end of the first elongate member can be secured by said retaining means.

3. Apparatus as claimed in claim 2 wherein said retaining means is a spring-loaded pin.

4. Apparatus as claimed in claim 1 or 2 wherein the first retaining means is a spring-loaded pin by which the first elongate member is securable to said upper bracket means in the stored position.

5. Apparatus as claimed in claim 3 wherein the spring-loaded pin can secure the first elongate member to the upper bracket means in the stored position.

6. Apparatus as claimed in claim 2 wherein the locations are apertures located in a plate lying in the plane of the ladder, and the first elongate member has an aperture which registers with one of the plurality of apertures when the stabiliser is in the stored position, and said stabiliser being retained in a stored position by a spring loaded pin which passes through a pair of registered apertures.

7. Apparatus as claimed in claim 1 wherein the upper bracket means is coupled to two elongate rods which pass through respective rungs of the ladder and which are fastened at the other side of the ladder.

8. Apparatus as claimed in claim 1 wherein the second elongate member has its other end pivotably connected to the first elongated member intermediate its ends.

9. Apparatus as claimed in claim 1 wherein said second elongate member has its other end pivotably connected to the first elongate member at the other end of the first elongate member.

10. Apparatus as claimed in any one of claims 1, 8 or 9 wherein the other end of the elongated member has a swivel foot connected thereto, the swivel foot being movable between in-use and out-of-use positions, and in said in-use position the foot lies parallel to the surface from which it is supported.

11. Apparatus as claimed in any one of claims 1, 8 or 9 wherein a stabilising device is securable to each side of the ladder, the elongate rods being fastened between respective pairs of upper and lower brackets.

12. A stabilising device as claimed in any one of claims 1, 2, or 6 wherein said first and second elongate members are dimensioned so that when folded in said stored position the second elongate member lies alongside the first elongate member.

13. Apparatus as claimed in any one of claims 1, 2 or 6 wherein the first member is generally C-shaped in cross-section and said lower member is generally T-shaped in cross-section, and in the stored position the centre portion of the T-shaped second elongate member fits into the recess of the C-shaped first elongate member.

14. Apparatus for use with a ladder having hollow rungs and comprising:

at least one stabilising device having first and second bracket means for securing the stabilising device at respective upper and lower positions along a side of the ladder, the first bracket means being connected to ends of two elongate rods which can be passed through two adjacent rungs of the ladder and which are fastened at the other side of the ladder, the second bracket means being connected to an end of an elongate rod which can be passed through a lower rung of the ladder and which is fastened at the other side of the ladder;

the upper bracket means having a plate in the plane of the ladder and extending lengthwise of the ladder, the plate having a plurality of apertures spaced in the direction of the ladder, a first rigid elongate member having an aperture at one end which is registrable with one of said plurality of apertures, said first rigid elongate member and said bracket being secured by a spring-loaded pin which can be passed through said registered apertures, the other end of the first rigid elongate member having a foot for supporting the stabiliser and the ladder, a second rigid elongate member shorter than the first rigid elongate member which has one end pivotably connected to the lower bracket means at its other end pivotably connected to the second elongate member at a location intermediate its ends, the pivotal connections permitting movement of the first and second elongate members in the plane of the ladder, the first elongate member having an aperture intermediate its ends for facilitating storage of the stabiliser, the stabiliser being movable between an in-use position and a stored position;

whereby in the in-use position, the second elongate member spaces the first elongate member from the side of the ladder at an angle so that the other end of the second elongate member is spaced from the foot of the ladder and acts as a foot effectively extending the base width of the ladder, and the other end of the second rigid elongate member being height adjustable relative to the feet of the ladder by selectively securing said one end of the first elongate members with the upper bracket by said spring-loaded pin with one of said plurality of apertures, and in the stored position the first and second elongate members are folded to lie along the side of the ladder and said stabiliser can be retained in said stored position by passing said spring-loaded pin through one of said plurality of apertures and said intermediate aperture which register in the stored position.

15. Apparatus as claimed in claim 2 wherein a pair of stabilising devices are secured to each side of the ladder and respective upper and lower elongate rods being fastened between respective upper and lower brackets.

* * * * *